United States Patent [19]

Czernik et al.

[11] 4,033,005

[45] July 5, 1977

[54] BEARING PAD ASSEMBLY

[75] Inventors: Daniel E. Czernik, Hinsdale; John F. Brady, Wood Dale, both of Ill.

[73] Assignee: Felt Products Mfg. Co., Skokie, Ill.

[22] Filed: Dec. 20, 1974

[21] Appl. No.: 534,708

[52] U.S. Cl. ..... 14/16.1; 248/22; 308/3 R

[51] Int. Cl.[2] ..... E01D 19/06

[58] Field of Search ..... 14/16 B; 248/22; 308/3 R

[56] References Cited

UNITED STATES PATENTS

| | | | |
|---|---|---|---|
| 1,781,517 | 11/1930 | McKeown | 14/16 X |
| 2,680,259 | 6/1954 | Milk | 14/16 |
| 2,705,928 | 4/1955 | Pont | 14/16 X |
| 2,911,207 | 11/1959 | Coble | 248/22 X |
| 3,105,252 | 10/1963 | Milk | 14/16 |
| 3,301,609 | 1/1967 | Palfreyman | 14/16 X |
| 3,325,842 | 6/1967 | Spencer | 14/16 |
| 3,329,472 | 7/1967 | Donnellan | 14/16 X |
| 3,349,418 | 10/1967 | Hein | 14/16 |
| 3,397,856 | 4/1968 | Sullivan | 14/16 X |
| 3,460,786 | 8/1969 | Rivin | 248/22 |
| 3,484,882 | 12/1969 | Blanchette | 14/16 |
| 3,514,165 | 5/1970 | Marsh | 14/16 X |
| 3,544,415 | 12/1970 | Price | 14/16 |
| 3,806,975 | 4/1974 | Fyfe | 14/16 |

FOREIGN PATENTS OR APPLICATIONS

| | | | |
|---|---|---|---|
| 249,729 | 7/1966 | Austria | 14/16 |

OTHER PUBLICATIONS

Long Island Railroad; W.S.P. 72-1, F.A.P.S.C. 23312; Elimination of Grade Crossing, Merrick-Bellmore, Merrick-Viaduct.

*Primary Examiner*—Nile C. Byers
*Attorney, Agent, or Firm*—Dressler, Goldsmith, Clement, Gordon & Shore, Ltd.

[57] ABSTRACT

A bridge bearing assembly comprising an elastomeric bearing pad having side edges and end edges. The bearing pad has contactor surfaces extending upwardly from a mounting plate. A metallic shear controller pin fixed to the mounting plate is positioned adjacent the contactor surfaces. It has surface portions spaced from, but positioned to contact, the contactor surfaces when the bearing pad is deformed in shear in the direction of the end edges. The upper surface of the bearing pad is in contact with a slide plate. Controller pins may be positioned in an opening in, or at end edges of the bearing pad and may be cylindrical or frustoconical. Temperature compensating indicators are provided on the bearing assembly for selectively positioning the slide plate relative to the bearing pad. Preinstallation connectors for securing the slide plate to the bearing pad may be used to help prevent separation of the slide surfaces of the slide plate and bearing pad.

9 Claims, 6 Drawing Figures

FIG. 1
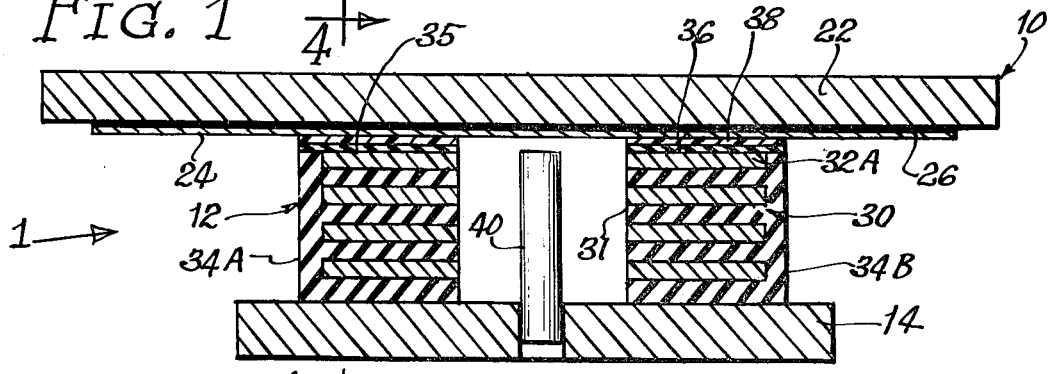
FIG. 2
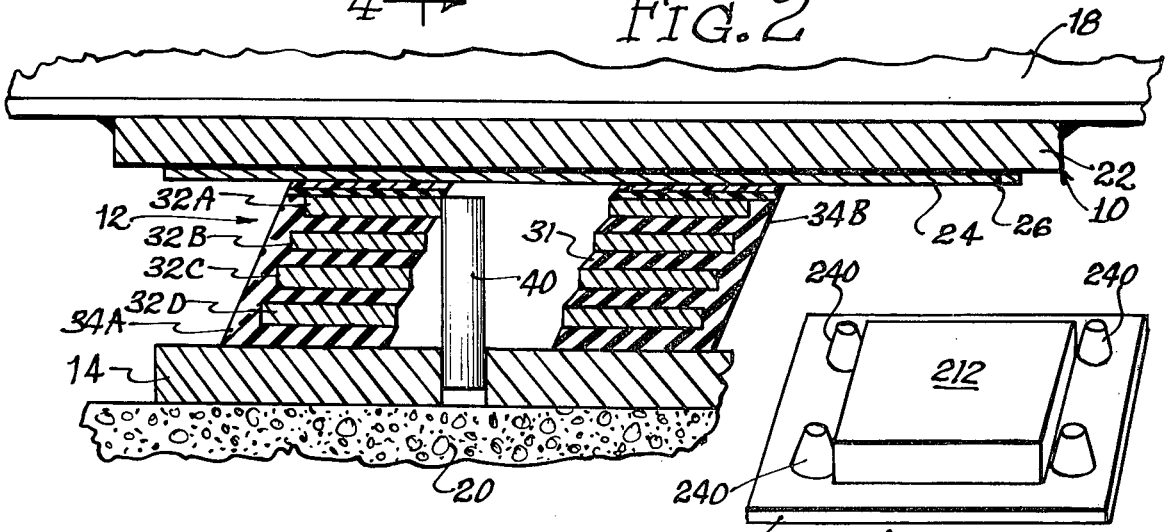
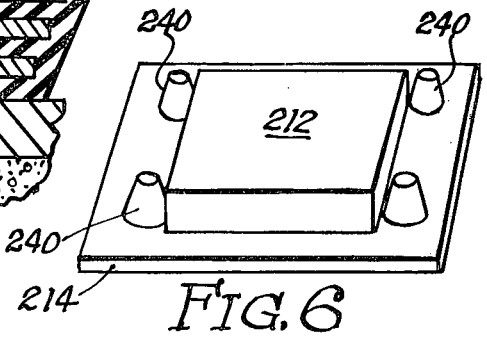
FIG. 6
FIG. 3
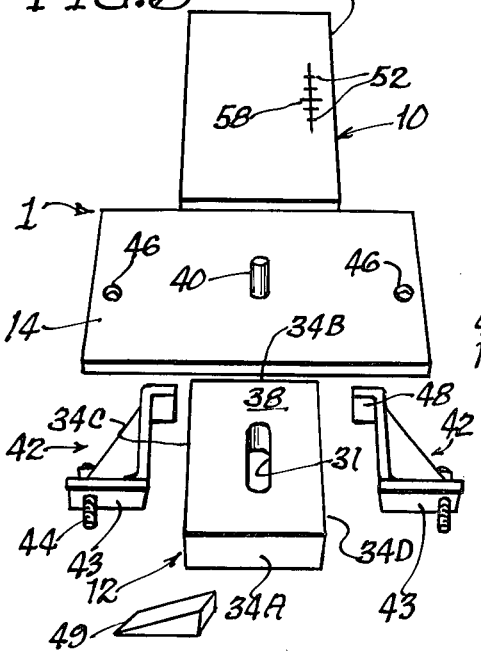
FIG. 4
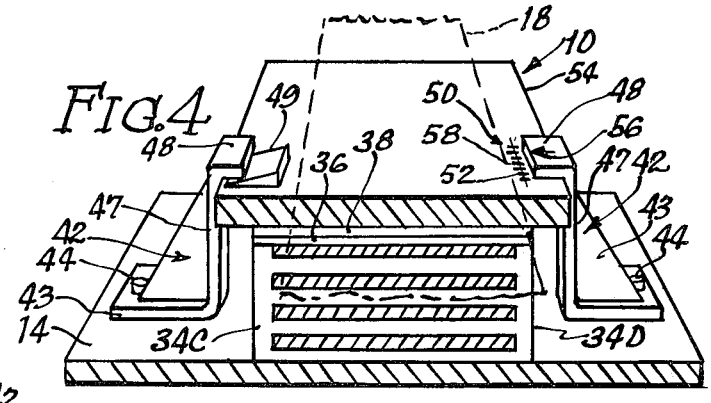
FIG. 5
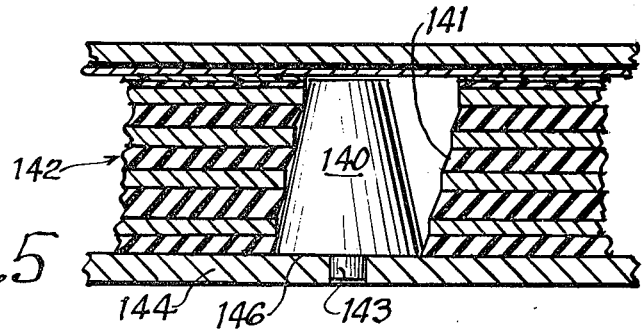

BEARING PAD ASSEMBLY

This invention relates to an improved bearing assembly adapted to be used in a bridge construction to facilitate and to control movement between a load carrying member of a bridge and a bridge support structure.

A wide variety of bearing assemblies have been designed and used to permit limited movement of the load carrying members of a bridge with respect to the bridge support structure. These assemblies have ranged from mechanical rocker and roller bearings to the more recently introduced elastomeric bearings with their many known advantages.

Elastomeric bearings are not, however, uniformly usable in bridge constructions. Among the major reasons for this the limitation thelimitation on the space available for the installation of a bearing and the size requirements of elastomeric bearings. The bearings must be proportioned to the load to be supported and to the anticipated movement of the load carrying member. Of course, an adequate factor of safety must be designed into the bearing. All of these requirements frequently can demand a bearing too large to fit into the space available in a bridge construction or too large to be used for other practical reasons.

One approach to reducing the size requirements of an elastomeric bearing has been to provide a Teflon slide surface on the bearing confronting a complementary slide surface. This permits sliding movement, rather than requiring the bearing pad to move entirely in shear and thereby permits a reduction in the bearing pad dimension while retaining an adequate factor of safety. Here again, however, this is not always satisfactory in terms of adequate size reduction and does not satisfy all bridge designers.

It is with improvements in bearing pads which facilitate further size reduction for a given loading and which provide a further factor of safety against bearing failure, hence against bridge failure, which this invention is concerned with.

In one of its aspects, a bearing assembly of this invention comprises a mounting plate, an elastomeric bearing pad having side edges and end edges, being mounted on said mounting plate and defining contactor surfaces extending upwardly from said mounting plate, and high strength metallic shear controlling means fixed with and extending upwardly from said mounting plate and positioned adjacent said contactor surfaces but having surface portions spaced from and being proportioned relative to said contactor surfaces to contact said bearing pad contactor surfaces when said bearing pad is excessively strained in shear beyond a predetermined amount in the direction of said end edges and deformed toward said controlling means, and in which said bearing pad has a generally flat expansive upper surface. The bearing assembly further comprises a slide plate assembly having a generally flat lower face of greater expanse than said upper surface in slidable contact with said upper surface and overlying said upper surface. Desirably at least one shim is embedded in the bearing pad and the shear controlling means extends upwardly to the elevation of the shim so that when the bearing pad is excessively strained, an upper end portion of the shear controlling means will bear against the shim to restrict further movement of the bearing pad relative to the shear controlling means. Although a preferred bearing pad has a superposed Teflon layer to facilitate sliding of the slide plate relative to the bearing pad, shear controlling means of this invention may be used with conventional elastomeric bearing pads as well, in which event the slide plate need only be a member against which the pad bears for relative movement when the shear controlling means acts to resist excessive and destructive shearing of the pad.

In some forms the bearing pad defines a central opening or slot in which a controller pin is positioned to contact opening contactor surfaces as the pad is deformed. In other forms the contactor surfaces are at edges of the pad and the controller pins are positioned externally of the pad to engage the contactor surfaces.

Further to facilitate installation of elastomeric bearing pads and to resist certain undesired movements of a slide plate relative to a bearing pad under loading, this invention provides a preassembled bearing construction ready for installation in a bridge construction. In accordance with that aspect of this invention, a bearing assembly commprises a mounting plate, an elastomeric bearing pad mounted on the mounting plate, the elastomeric bearing pad having a generally flat, expansive upper surface and side and end edges, the slide plate having side and end edges and a generally flat lower face of greater expanse than the upper surface in slidable contact with said upper surface and connector means at the side edges connected to the mounting plate securing the slide plate in overlying relation to the bearing pad, thereby to prevent movement of the slide plate assembly in the direction of the side edges. The connector means secure the bearing pad and slide plate in preassembled condition and, after assembly in a bridge construction, serve to restrain lateral movement of the slide plate assembly therein as well as to help prevent separation of the contacting surfaces of the slide plate assembly and the elastomeric bearing pad.

To that end, in a preferred embodiment, the connector means comprise upstanding portions straddling the side edges of the slide plate assembly and angled portions overlying opposite side edges of the slide plate assembly. In addition to restraining undesired lateral movement and separation of slide assembly and pad, the connector means may also serve to limit the extent to which the slide plate assembly, hence the load carrying member, may oscillate or roll. The restraint provided by the connector means will always tend to help insure full face contact between the slide surfaces, thereby to prevent the intrusion of roadway dirt, grit or other foreign material which might adversely affect the antifriction characteristics of the confronting slide surfaces.

Further to assist in the proper installation of a bearing assembly of this invention, and so that the deviation of the temperature of installation from the mean design temperature is properly compensated for, alignable position indicating means for selectively positioning the slide plate assembly longitudinally relative to the end edges of the bearing pad are provided. First indicator means, such as temperature calibrations, are desirably provided on the slide plate assembly and second indicator means are provided on the connector means. When the bearing pad and slide plate assembly are aligned via the alignable position indicating means to coincide with the temperature of installation and are then fixed to their respective support members, the slide plate assembly will always properly cover the bearing pad within the range of temperatures designed for.

Further objects, features and advantages of this invention will become apparent from the following description and drawings, of which:

FIG. 1 is a side elevational view, partially in section, of a bridge bearing assembly according to this invention;

FIG. 2 is a side elevational view of the assembly of FIG. 1 installed in a bridge construction and acted on in shear;

FIG. 3 is an exploded perspective view of the bridge bearing assembly of FIG. 1;

FIG. 4 is a perspective view, partially in section, of the bridge bearing assembly of FIG. 1;

FIG. 5 is a cross-section view, similar to FIG. 2, illustrating a further embodiment of this invention; and FIG. 6 is a perspective view illustrating yet another embodiment of this invention.

Referring now to the drawings, a presently preferred embodiment of a bearing assembly 1 of this invention is seen to include a slide plate assembly 10, a bearing pad 12 and a mounting or masonary plate 14. Slide plate assembly 10 is adapted to be mounted and secured fast with a load carrying member, such as a bridge beam 18. Bearing pad 12 is adapted to be supported on, and mounted on and fastened to a bridge support, such as an abutment or a pier 20, via mounting plate 14 to which bearing pad 12 is secured.

Slide plate assembly 10 may desirably comprise a mounting plate 22 and a slide plate 24. Mounting plate 22 may be made of rolled steel, and the slide plate 24 is preferably made of a highly polished stainless steel. Slide plate 24 may be secured to mounting plate 22 as by welding or may preferably be secured to the mounting plate by an elastomeric cushioning layer 26, such as of polychloroprene, which also acts adhesively to secure mounting plate 22 to slide plate 24. Elastomeric layer 26 will serve as a cushioning layer to allow localized vertical movement between the slide plate 24 and mounting plate 22, thereby providing a more uniform stress distribution on the bearing itself and thereby maintaining more intimate contact between slide plate 24 and the bearing pad 12 so as to prevent the intrusion of dirt or other extraneous materials which would tend to destroy the antifriction characteristics of this portion of the bearing assembly.

Bearing pad 12 comprises an elastomeric main body portion 30 of natural rubber or of a synthetic rubber such as polychloroprene or the like, typically of a durometer of about 50 to 60 according to ASTM Hardness specification D2240. Embedded within the main body portion are a plurality of expansive, steel shims or stiffening plates 32A to 32D which are of rolled steel. The thickness and number of shims employed will depend upon the size of the bearing, the shear stress values to be encountered, and the range of movement of bridge beam 18 with respect to pier 20. Typically, shims 32A to 32D will be from about ⅛ to 5/16 inch in thickness.

The main body portion 30 is preferably molded as a rectangular parallelopiped with generally rectangular, preferably solid, shims 32A to 32D lying between and generally parallel to the upper and lower surfaces of the main body portion 30. Main body portion 30 has end edges 34A and 34B and side edges 34C and 34D. Extending upwardly from the base of the bearing pad and completely through the main body portion 30 is an elongate opening 31. Opening 31 is generally elliptical in shape in plan view, it centrally located within main body portion 30, and is oriented longitudinally in the direction of the end edges 34A and 34B. In a bearing pad having dimensions of about 12 by 18 by 5 inches, opening 31 may desirably be about 5½ inches long and about 1¾ inches wide. As will become clear, among other things, the size of the opening will be a function of the movement in shear which the bridge designer will permit for the particular bridge under consideration.

The top surface 35 of the main body portion may be vulcanized with a relatively harder intermediate layer 36, such as a layer of hard rubber, i.e., a layer which is harder than that of the main body portion. This layer is desirably about 1/16 to ¼ inch in thickness. Preferably, no appreciable thickness of the elastomeric main body portion 30 should be positioned between shim 32A and the intermediate layer 36 because the functional characteristics of layer 36 will be most effective if it is secured substantially directly to the uppermost shim 32A.

An upper layer 38 consisting of a substance with a low coefficient of friction, such as a fluorinated hydrocarbon polymeric material, is provided on the uppermost surface of the intermediate layer 36 to provide the upper slide surface of the bearing pad. In the preferred embodiment the upper layer is a sheet of polytetrafluoroethylene, such as Teflon, approximately 1/16 inch in thickness which is preferably bonded to the intermediate layer 36 during vulcanization. The upper slide surface of the bearing pad 12 desirably presents a smaller surface area than does the overlying lower surface or face of slide plate 24. That serves to insure that despite movement of the slide plate 24 relative to the upper slide surface of the bearing pad within the designed-for range of movement, the upper surface of the bearing pad will remain covered and therefore will not be exposed to the environment, hence will not accumulate dirt or other foreign matter which would tend to destroy the low friction characteristics of the mating slide surfaces.

The lower surface of the main body portion 30 is desirably secured, as adhesively, to the generally flat mounting or pier plate 14 which is in turn permanently anchored to a surface of a pier 20. Mounting plate 14 may be rigid material such as steel of suitable thickness.

In accordance with this invention a shear controlling member such as shear controller pin 40 is provided. Controller pin 40 extends upwardly from the bridge support or pier and in the embodiment illustrated is fixed to mounting plate 14 generally centrally thereof and extends upwardly from the mounting plate 14 through the elongate opening 31 in the main body portion 30. When an opening 31 is of the dimensions referred to above, a pin approximately 1½ inches in diameter may be used. As such, the controller pin will be closely adjacent the side edges of opening 31 and will act to restrain movement in that direction and when main body portion 30 is in an unstressed condition, the pin will be substantially spaced from the contact surfaces of the longitudinal ends of the opening 31. When the main body portion 30 is stressed in shear, as illustrated in FIG. 2, and consequently is deformed in one direction, the controller pin is proportioned relative to the opening 31 such that contact by a portion of its surface with the surface of the main body portion 30 and with shim plate 32A is made at one of the longitudinal ends of opening 31. Pin 40 extends upwardly sufficiently far to engage the bearing pad at the elevation of the uppermost shim at a longitudinal end of the opening when the bearing pad is excessively strained. Pin 40 is preferably made of steel quenched and tempered to a minimum yield strength of at least 150,000 psi, thereby to provide great strength and very great resistence to excessive movement and deformation of the bearing pad in shear.

The controller pin 40 may be cylindrical in shape, as illustrated. However, other shapes of pin and opening are clearly contemplated and are feasible. For example, as shown in FIG. 5, a pin 140 having a main body section defining a frustrum of a right circular cone may be used. The angle of the surface of the cone will be complementary to the angle of the end contactor surfaces of the opening 141 in bearing pad 142 at the time the complementary surface portions of the shear controller pin 140 are to become operative. Secondly, pads 142 may be designed with a degree of uniformity in their size, construction and slot dimensions, with the control for the amount of deformation depending upon the shear controller pin shape to be used with the pad.

In addition to permitting a greater degree of flexibility in pad design, a frustroconical controller pin 140 makes it possible to reduce stresses developed in the pin and plate, as well as in the bearing pad. As seen in FIG. 5, pin 140 has a cylindrical mounting plug 143 which is press fit into masonry plate 144. The shoulder portion 146 provides a bearing surface which, when the pin is stressed, acts with the cylindrical surface of plug 143 to distribute the stresses over the masonry plate. That makes it possible to use a lower strength pin (as compared to a cylindrical rod like pin 140) press fit within the plate as shown in FIG. 1 & 2, and also makes it possible to use a thinner masonry plate because the loads are better distributed. Of course this contributes to a thinner overall bearing pad assembly making the pad assembly of this invention usable in more low-profile environments then was possible previously. Moreover, because the pin 140 is tapered, it will contact a plurality of shims when it becomes operative, thereby disbributing the loads over the entire pad more evenly. This makes it possible to use thinner pad shims.

As shown by FIGS. 3 and 4, bearing pad assembly 1 is adapted to be preassembled for shipment and subsequent installation as by connecting slide plate assembly 10, bearing pad 12, and pier plate 14 with connector means 42. Connector means 42 may comprise a pair of connecting and restraining means such as generally Z-shaped brackets 43, one on each side of bearing assembly 1. Each bracket 43 is secured to mounting plate 14 as with bolt 44 which are threadedly received in one or more threaded holes 46 in each mounting plate 14.

Brackets 43 which straddle side edges of the slide plate assembly and bearing pad and which secure slide plate assembly 10 and bearing pad 12 to mounting plate 14, include generally vertical restraining flanges 47 and generally horizontal restraining flanges 48. The vertical flanges 47 which are but slightly spaced from the side edges of the slide plate, such as by about ¼ inch, tend to restrain and resist movement of the slide plate assembly in the direction of the side edges of the bearing pad. The flanges 48, which are spaced from, as by about ¼ inch, but which overlie side edges of the slide plate assembly, tend to limit the upward movement of the slide plate beyond a predetermined amount relative to the bearing pad should the slide plate assembly tend to roll or to lift up at one edge, thereby to help maintain contact between the confronting slide surfaces.

When the connecting be described are used, the bearing pad assembly 1 can e easily handled and shipped and can then easily be installed. During shipment the slide plate assembly is held in the assembly 1 as by securing means such as removeable wedges 49 positioned between the plate assembly 10 and the horizontal flanges 48. One such wedge is illustrated in FIG. 4. Once assembly 1 is positioned for installation, wedges 49 are removed to provide the desired clearance between flanges 48 and slide plate assembly 10. Other securing means than wedges might be used such as strapping or the like. Once installed, the connecting means restrict and tend to limit unwanted and excessive relative movements between the bearing pad and the confronting slide plate assembly.

FIG. 2 shows a bridge bearing assembly 1 of this invention installed and under load. It illustrates the bearing pad 12 as having deformed in shear. As the shear stresses increase, the elastomeric main body portion 30 deforms. At a predetermined point, such as when the frictional force between the stainless steel and Teflon surfaces of the slide plate assembly 10 and bearing pad 12 reaches a design value the frictional resistance to movement of the slide plate will be overcome and the slide plate will then slide relative to the Teflon surface. Once frictional resistance to sliding is overcome the shear stress remains substantially constant until the direction of the slide plate movement reverses.

The design of elastomeric bearing pads and the size and shape of elastomeric bearing pads depends upon a number of factors. Among other things, there must be a sufficient thickness of rubber to accommodate shear stresses within the designed-for range of movement of a load carrying member of a bridge and the bridge support. Further, an adequate factor of safety must be provided for to accommodate temporary unusual or abnormal stresses. Space and size restrictions in bridge constructions have sometimes made it impossible to use conventional elastomeric bearing pads. One approach to reducing the size requirements of bearing pads, while retaining an adequate factor of safety, has been to provide a bearing pad with a slide surface which can slide with respect to a slide plate assembly so that the pad will slide with respect to the load bearing member before the pad is excessively stressed in shear. Even in these constructions, acceptable design practice sometimes requires pad dimensions and rubber thickness which are too great for the available space or for the bridge support and load bearing members which are to be used. For example, in some cases bearing pad thickness must be so great that the pad is too thick relative to its base dimensions. In such cases the pad would be unstable and the thickness would exceed the maximum permissible relative to base dimensions such as AASHTO'S three to one (3 to 1) limit. The use of a Teflon slide surface permits a reduction in rubber thickness which in some cases makes a return to acceptable height to base dimensions possible. The use of the controller pin of this invention permits a further reduction in thickness making bearing pads usuable in environments where they were not usuable previously.

The high strength controller pin 40 of this invention will absorb and withstand very substantial loading. Accordingly, it is possible to design an elastomeric bearing pad assembly having an adequate factor of safety in shear partially provided by the shear limiting member of this invention, rather than entirely provided by elastomer thickness. As a consequence, in some cases, a bearing pad may also be made narrower and shorter, because those dimensions also, in part, are dependent on thickness. This means that in bridges with large anticipated expansions, a significantly smaller bearing assembly than was used in the past can safely be employed.

The shear controller pin 40 also tends to resist lateral shear of the bearing pad, which might conceivably occur under abnormal conditions of loading. This may well help to prevent failure of a bearing pad, hence of a bridge. Further, if the frictional resistance to movement of the slide surfaces for some reason or other were to increase, then before a bearing pad was excessively stressed in shear, the controller pin would limit the longitudinal movement of the bearing pad in shear, thereby to force the surfaces into relative movement and to prevent failure of the bearing assembly and bridge. Being positioned to prevent excessive shear stresses, the shear controlling member 40 makes it possible to design an overall bridge construction in which elastomeric bearings may be used, where they might not otherwise have been usable as well as protects against damage under a variety of abnormal stress conditions.

The shear controller pin 40 may also be used with a bridge bearing pad that is not necessarily designed to slide with respect to a bridge beam. For example, a conventional elastomeric bearing pad without a top slide surface may be used with such a member. In that case, the pin will also prevent excessive shearing of the pad in the event that excessive movement beyond its designed range of movement, such as a result of minor earthquakes, minor shifts or pier supports 20 or abutments, or the like, would occur.

Because relative sliding movement between the bearing pad and slide plate will take place once the coefficient of friction between the bearing pad and slide plate of the embodiment described herein is overcome, it is unnecessary to temperature compensate bearing pads of the type described herein at the time of installation. However, it is important that the slide plate 24 be long enough to completely cover and remain in contact with the Teflon slide surface within the entire anticipated range of movement designed for. So that the slide plate may be of a minimum length and the bearing pad of a minimum size to accomplish this, alignable position indicator means 50 are provided for selectively positioning the slide plate assembly 10 longitudinally relative to the end edges of the bearing pad 12 in accordance with the temperature of installation. Typical alignable position indicator means 50 may comprise a scale of temperature markings or calibrations 52, as along one side edge 54 of slide plate assembly 10, and a temperature indicator or selector, such as arrow 56, marked as shown on bracket 43 for selectively positioning the slide plate relative to the bearing pad in accordance with the temperature at the time of the installation of the assembly. Because it is desirable centrally to position the slide plate assembly 10 relative to the bearing pad 12 at the mean temperature, the calibration indicating the mean temperature is located at the midpoint 58 of slide plate assembly 10. Thus, given the installation temperature and the range of anticipated ambient temperatures, the position indicator means 50 may be used selectively to position slide plate assembly 10 relative to bearing pad 12 so as to insure that the polytetrafluoroethylene layer 38 will always be covered and protected by slide plate 24 and so that full surface engagement will always be provided between the complementary slide surfaces.

FIG. 6 illustrates yet another embodiment of this invention. In FIG. 6, mounting plate 214 is provided as a support for bearing pad 212 which may be like bearing pad 12 without, however, the slot or opening 31. At the end edges of pad 212 shear controlling means comprising two laterally spaced pairs of shear controller pins 240 are provided at each end edge of bearing pad 212. Pins 240 may be configured and fitted to plate 214 as was pin 140 except that they are external, rather than internal of bearing pad 212. As bearing pad 212 is stressed by its associated slide plate (not shown), it deforms as did pads 12, and 142 until it reaches a shape at which its external end contactor surface engages the complementary confronting surfaces of pins 240 and at which point further movement of the pad 212 is restrained and restricted, as previously described, by a pair of controller pins 240. Because of non-linear and rotational movements which are encountered in bridge use, although in some environments the embodiment of FIG. 6 is of substantial advantage, in most bridge environments the use of internal, centrally located pins such as illustrated in FIGS. 1 and 5, is preferred.

Although only several embodiments of this invention have been described and illustrated, it will be clear from the foregoing specification and drawings that modifications may be made without departing from the spirit and scope of this invention. Accordingly, the invention disclosed herein is intended to be limited only as may be required by the claims.

What is claimed is:

1. A bearing assembly ready for installation in a bridge construction comprising a mounting plate, an elastomeric bearing pad mounted on said mounting plate, said bearing pad having a generally flat expansive upper surface and side and end edges, an upper layer of polytetrafluorethylene intimately contacting and secured to said upper surface so as to overlie said upper surface and provide an upper slide surface for said bearing pad, a slide plate assembly having side and end edges and a generally flat lower face of greater expanse than said upper surface in slidable contact with said upper slide surface, and connector means at said side edges and connected to said mounting plate securing said slide plate in overlying relation to said bearing pad to prevent movement of said slide plate assembly in the direction of its side edges.

2. A bearing assembly in accordance with claim 1 in which said connector means comprise upstanding portions straddling said side edges and angled portions overlying side edges of said slide plate assembly further to help prevent separation of the contacting slide surfaces of said slide plate assembly and said bearing pad.

3. A bearing assembly in accordance with claim 1 further comprising alignable position indicator means on said connector means and on said slide plate for selectively positioning said slide plate assembly longitudinally relative to the end edges of said bearing pad in accordance with the temperature of installation.

4. A bridge construction comprising a load carrying member mounted for movement longitudinally of a bridge support and a bearing assembly interposed therebetween, said bearing assembly comprising a mounting plate and an elastomeric bearing pad having side edges and end edges and defining contactor surfaces extending upwardly from said mounting plate, said bearing pad having at least one expansive shim embedded therein and a generally flat expansive upper surface, said shim being substantially coextensive with the dimensions of the upper surface of the bearing pad, high strength metallic shear controlling means fixed to and extending upwardly from said mounting plate and positioned adjacent said contactor surfaces but having surface portions spaced from and proportioned relative to said contactor surfaces to contact said contactor surfaces at the elevation of a said embedded shim when said bearing pad is strained in shear beyond a predetermined amount in the direction of said end edges and is deformed toward said controlling means, an upper layer of polyetrafluoroethylene intimately contacting and secured to said upper surface so as to overlie said upper surface and to provide an upper slide surface for said bearing pad, and a slide plate secured to said load carrying member and having a generally flat lower slide face intimately contacting and of greater expanse than said upper surface and overlying said upper surface for accommodating sliding movement of said load carrying member relative to said elastomeric bearing pad.

5. A bridge construction in accordance with claim 4 in which said bearing pad defines an elongate opening extending upwardly from said bridge support and extending longitudinally in the direction of said end edges, and said opening defines said upwardly extending contactor surfaces at the longitudinal ends of said opening, said controlling means comprising a shear controller pin having confronting surface portions spaced from each of said contactor surfaces.

6. A bearing assembly ready for installation in a bridge construction, wherein said bridge construction includes a load carrying member and a bridge support, comprising a mounting plate for mounting upon said support, an elastomeric bearing pad having side edges and end edges and being mounted on said mounting plate and defining contactor surfaces extending upwardly from said mounting plate and having a generally flat expansive upper surface and having a generally flat expansive upper surface and embedding shim means spaced above said mounting plate and lying generally parallel to said upper surface, high strength metallic shear controlling means fixed to and extending upwardly from said mounting plate at least to the elevation of said shim means and positioned adjacent said contactor surfaces but having surface portions spaced from and proportioned relative to said contactor surfaces so that when said bearing pad is strained in shear beyond a predetermined amount in the direction of said end edges and is deformed toward said shear controlling means, said shear controlling means will bear against said bearing pad at the elevation of said shim means, and upper layer of polytetrafluoroethylene intimately contacting and secured to said upper surface so as to overlie said upper surface and provide an upper slide surface for said bearing pad, and a slide plate for mounting to said load carrying member and having a generally flat slide surface intimately contacting and of greater expanse than said upper slide surface of said elastomeric bearing pad for accommodating sliding movement of said slide plate relative to said elastomeric bearing pad, and in which said bearing pad defines an elongated opening extending upwardly from said mounting plate and extending longitudinally in the direction of said end edges, and in which said opening defines said upwardly extending contactor surfaces, and in which said shear controlling means comprises a frustoconical shear controller pin having surface portions spaced from each of said contactor surfaces.

7. A bearing assembly ready for installation in a bridge construction, wherein said bridge construction includes a load carrying member and a bridge support, comprising a mounting plate for mounting upon said support, an elastomeric bearing pad having side edges and end edges and being mounted on said mounting plate and defining contactor surfaces extending upwardly from said mounting plate and having a generally flat expansive upper surface and embedding shim means spaced above said mounting plate and lying generally parallel to said upper surface, high strength metallic shear controlling means fixed to and extending upwardly from said mounting plate at least to the elevation of said shim means and positioned adjacent said contactor surfaces but having surface portions spaced from and proportioned relative to said contactor surfaces so that when said bearing pad is strained in shear beyond a predetermined amount in the direction of said end edges and is deformed toward said shear controlling means, said shear controlling means will bear against said bearing pad at the elevation of said shim means, an upper layer of polytetrafluoroethylene intimately contacting and secured to said upper surface so as to overlie said upper surface and provide an upper slide surface for said bearing pad, and a slide plate assembly for mounting to said load carrying member and having a generally flat slide surface intimately contacting and of greater expanse than said upper slide surface of said elastomeric bearing pad for accommodating sliding movement of said slide plate relative to said elastomeric bearing pad, and in which there are connector means provided at the side edges of said bearing pad, said connector means securing said slide plate assembly in overlying relation to said bearing pad to resist movement of said slide plate in the direction of the side edges of said bearing pad and to help prevent the separation of the contacting slide surfaces of said slide plate assembly and said bearing pad.

8. A bearing assembly in accordance with claim 7 comprising alignable position indicating means on said connector means and on said slide plate assembly for selectively positioning said slide plate assembly relative to said bearing pad in accordance with the temperature of installation.

9. A bridge construction comprising a load carrying member mounted for movement longitudinally of a bridge support and a bearing assembly interposed therebetween, said bearing assembly comprising an elastomeric bearing pad having side edges and end edges and defining contactor surfaces extending upwardly from said bridge support, said bearing pad having at least one shim therein and a generally flat expansive upper surface, high strength metallic shear controlling means fixed to and extending upwardly from said bridge support and positioned adjacent said contactor surfaces but having surface portions spaced from and proportioned relative to said contactor surfaces to contact said contactor surfaces at the elevation of said shim when said bearing pad is strained in shear beyond a predetermined amount in the direction of said end edges and is deformed toward said controlling means, an upper layer of polytetrafluroroethylene intimately contacting and secured to said upper surface so as to overlie said upper surface and provide an upper slide surface for said bearing pad, and a slide plate secured to said load carrying member and having a generally flat lower slide face intimately contacting and of greater expanse than said upper surface and overlying upper surface for accommodating sliding movement of said load carrying member relative to said elastomeric bearing pad, and further comprising connector means at the side edges of said bearing pad for securing said slide plate in overlying relationship to said bearing pad to resist movement of said slide plate in the direction of the side edges of said bearing pad and to help prevent separation of the contacting slide surfaces of said slide plate and said bearing pad.

* * * * *

UNITED STATES PATENT OFFICE

CERTIFICATE OF CORRECTION

Patent No. 4,033,005 Dated July 5, 1977

Inventor(s) Daniel E. Czernik et al.

It is certified that error appears in the above-identified patent and that said Letters Patent are hereby corrected as shown below:

Column 9, lines 42 and 43, delete "and having a generally flat expansive upper surface".

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,033,005 Dated July 5, 1977

Inventor(s) Daniel E. Czernik and John F.Brady

It is certified that error appears in the above-identified patent and that said Letters Patent are hereby corrected as shown below:

Col. 1, line 2, before "in" insert -- as --;

line 17, before "the" (first occurrence) insert -- are --;

line 17, delete "the limitation" (second occurrence);

Col. 2, line 21, "commprises" should be -- comprises --;

Col. 3, line 68, "it" should be -- is --;

Col. 6, line 3, before "described" insert -- means --;

line 3, delete "be";

line 5, "e" should be -- be --;

line 64, "usuable" should be -- usable --;

line 65, "usuable" should be -- usable --;

UNITED STATES PATENT OFFICE

CERTIFICATE OF CORRECTION

Patent No. 4,033,005 Dated July 5, 1977

Inventor(s) Daniel E. Czernik and John F. Brady

It is certified that error appears in the above-identified patent and that said Letters Patent are hereby corrected as shown below:

Claim 6, Column 9, line 56, "and" should be -- an --.

Claim 9, Column 10, line 56, "polytetrafluroroethylene" should be -- polytetrafluoroethylene --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*